United States Patent [19]

Droz

[11] Patent Number: 4,738,449

[45] Date of Patent: Apr. 19, 1988

[54] SCORE MARKER FOR TENNIS

[76] Inventor: François Droz, Prairie 46, CH-2300 La Chaux-de-Fonds, Switzerland

[21] Appl. No.: 859,687

[22] Filed: May 5, 1986

[30] Foreign Application Priority Data

May 8, 1985 [CH] Switzerland ..... 1945/85

[51] Int. Cl.[4] ..... A63B 71/00

[52] U.S. Cl. ..... 273/29 R; 116/225; 116/222; 273/73 R; 273/DIG. 26

[58] Field of Search ..... 116/222, 224, 225, 221; D10/46.1; 273/32 B, 73 R, 29 R; 40/491

[56] References Cited

U.S. PATENT DOCUMENTS

| | | | |
|---|---|---|---|
| 1,844,945 | 2/1932 | Collins | 116/324 |
| 2,866,433 | 12/1958 | Kallick et al. | 116/324 |
| 2,925,668 | 2/1960 | Forest | 116/323 |
| 3,292,851 | 12/1966 | Toppin et al. | 116/324 |
| 3,363,837 | 1/1968 | Gassino | 116/323 |
| 4,041,893 | 8/1977 | Mulloy | 116/321 |
| 4,132,187 | 1/1979 | Moebius | 116/225 |
| 4,158,342 | 1/1979 | Scruggs | 116/225 |
| 4,172,595 | 10/1979 | Sewell | 116/225 |
| 4,189,143 | 2/1980 | Van Auken et al. | 116/222 |
| 4,357,895 | 11/1982 | Nightingale | 116/225 |
| 4,557,215 | 12/1985 | Petersson | 116/222 |

FOREIGN PATENT DOCUMENTS

| | | | |
|---|---|---|---|
| 3038094 | 5/1982 | Fed. Rep. of Germany | 273/29 R |

*Primary Examiner*—Richard C. Pinkham
*Assistant Examiner*—T. Brown
*Attorney, Agent, or Firm*—Pollock, Vande Sande & Priddy

[57] ABSTRACT

The invention comprises a score marker for tennis including a base pierced with three slots arranged in U form. Each slot is provided with a cursor associated with positioning means which in the case of the two parallel slots enables retention of the cursor in four predetermined positions so as to display the points 0, 15, 30 and 40 and in the case of the third slot enables retention of the cursor in three predetermined positions in which it indicates in the central position equality of the players and in the end positions to which player the advantage belongs.

15 Claims, 3 Drawing Sheets

FIG. 3
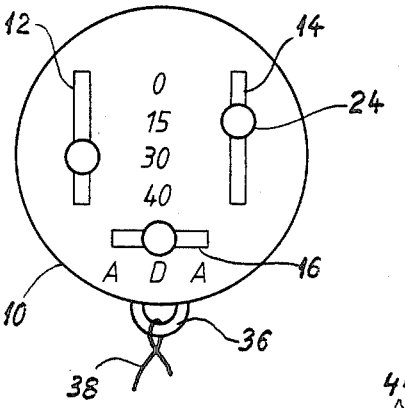
FIG. 5
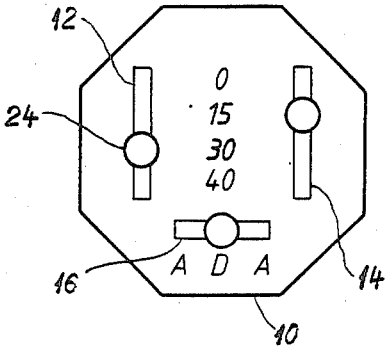
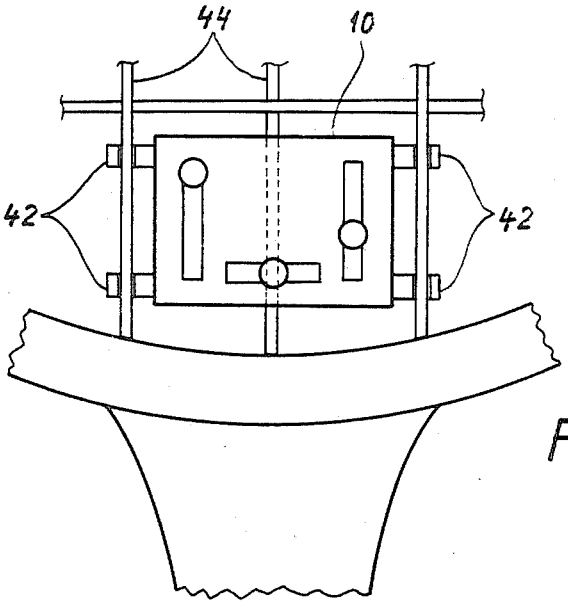
FIG. 9
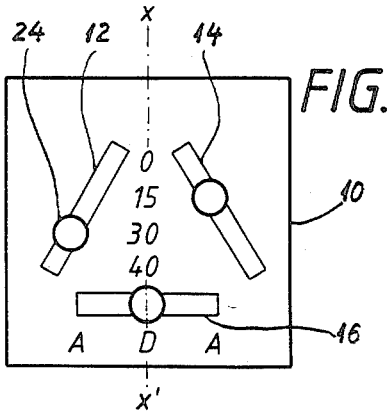
FIG. 6
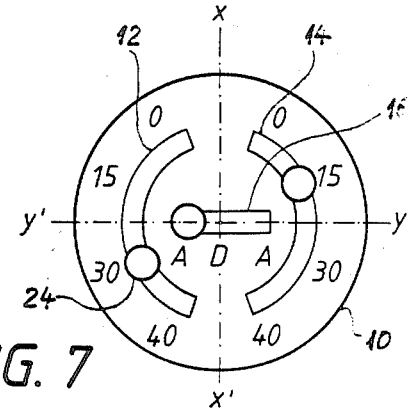
FIG. 7

FIG. 4
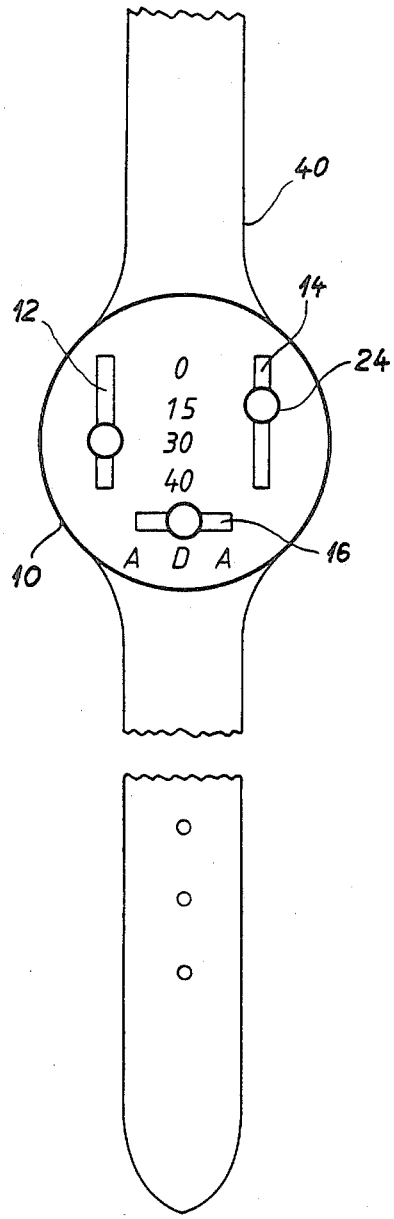
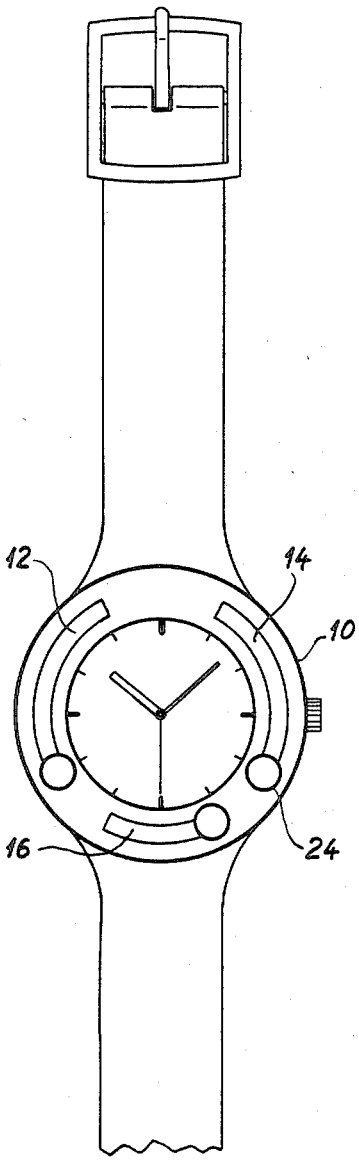
FIG. 8

SCORE MARKER FOR TENNIS

TECHNICAL FIELD

This invention concerns marking of the score during tennis games, in particular it concerns an appliance of small dimensions enabling a tennis player to mark the game score himself.

BACKGROUND OF THE INVENTION

U.S. Pat. No. 4,172,595 describes a score marker of the type hereinabove which is adapted to be placed on the end of the handle of the tennis racket and which conforms to the octagonal form thereof. It is basically formed of a base pierced with two parallel slots and two cursors respectively engaged in the slots along which indexing means enable blocking them in four predetermined positions corresponding respectively to the points 0, 15, 30 and 40.

Such system however does not present the possibility of indicating once both players have arrived at a score of 40, whether there is equality or, if not, to which player the advantage belongs. This information also appears to be useful to the player.

This invention has its purpose to provide a score marker for tennis which provides such a possibility.

SUMMARY OF THE INVENTION

The invention thus comprises:

a base provided with three slots of which two first slots of the same length are symmetrically arranged and constitute scales for marking respectively the points 0, 15, 30 and 40 of the players and of which the third slot is placed in a manner such that its two ends are unambiguously located respectively in proximity to the two first slots and enable, once the opposing players have achieved the score of 40, to indicate whether there is equality or to which the advantage belongs;

three cursors respectively placed in said slots so as to be able to be slid therealong; and positioning means serving on one hand to retain the cursors of the two first slots in four predetermined positions in which they display the points 0, 15, 30 and 40 and on the other hand to retain the cursor of the third slot in three predetermined positions in the central position of which it indicates equality of the layers and in the end positions that the advantage belongs to the player whose points are displayed on the closest scale.

BRIEF DESCRIPTION OF THE DRAWINGS

FIG. 3 shows the possibility of wearing the marker in accordance with the invention as a pendant;

FIG. 4 shows a variant of the invention in which the marker is associated with a bracelet;

FIGS. 5, 6 and 7 show other forms of realization of the marker;

FIG. 8 shows the association of the marker with a watch;

FIG. 9 shows the possibility of attaching the marker to the stringing of a tennis racket.

DESCRIPTION OF THE PREFERRED EMBODIMENT

Figure 2:
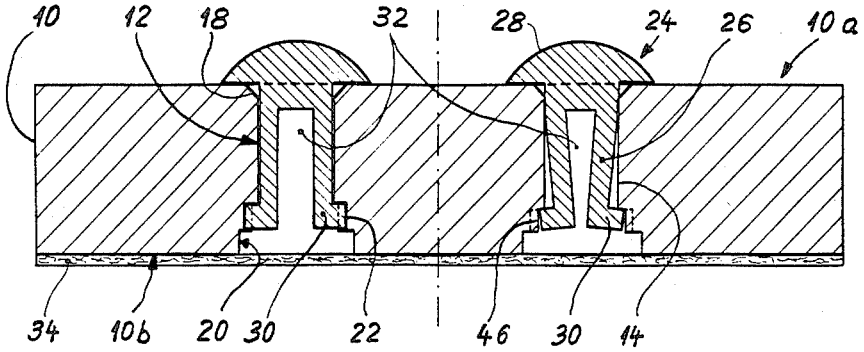
FIG. 2 is a cross-section of the marker of FIG. 1.
Figure 1:
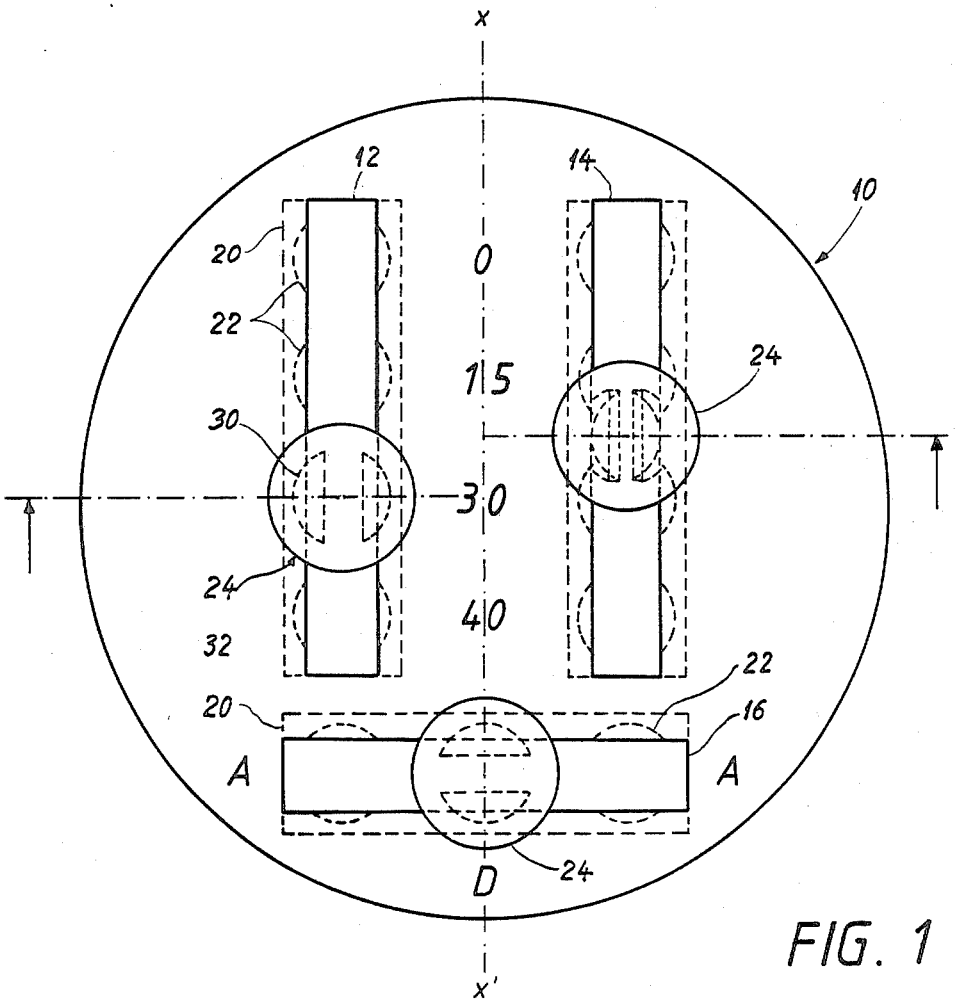
FIG. 1 is a plan view of a first form of a score marker according to the invention.

The marker shown on FIGS. 1 and 2 has a base element a block 10 in the form of a disc which is pierced with three rectilinear elongated slots 12, 14 and 16 arranged in U form. Slots 12 and 14 which are the same length are parallel to the axis x'x of the disc and symmetrically disposed relative to the latter. They are displaced towards the upper half (on FIG. 1) of the disc, thus leaving in the lower portion a place for slot 16. The latter is perpendicular to the axis x'x and has a length which corresponds roughly to the distance separating the outer edges of the parallel slots 12 and 14.

The three slots have, in the sense of the thickness of the block 10, profiles which are completely identical. As shown on FIG. 2, each slot, bounded by two parallel walls, opens out on the front face **10*a* of the block by a flared portion 18 (for reasons of simplification, not shown on FIG. 1) and on its back surface 10*b* by a simple rectangular slot 20. The latter is itself pierced by small cylindrical receptacles or positioning notches 22 which are centered on the axis of the slots. Slots 12 and 14 include four of these receptacles which are regularly spaced out. Slot 16 includes only three thereof. The central receptacle is centered on the axis x'x of the block while the other two are located in the prolongation of the axes of slots 12 and 14**.

Inscriptions 0, 15, 30 and 40 are advantageously placed between slots 12 and 14 at the level of their four positioning notches 22. The letter D, for "DEUCE" ("equality at forty") is inscribed on the surface proximate the central notch of slot 16, while the letter A from "ADVANTAGE" is inscribed facing the other two notches.

The three slots 12, 14 and 16 are each intended to receive a cursor 24 formed from an elastically deformable material. The latter comprises a body 26 and at its respective extremities, a rounded head 28 supported on the front face **10*a* and a circular shoulder 30 of diameter corresponding to that of the positioning notches 22. The body 26 exhibits two planar parallel surfaces which are opposite the walls of the slot. The shoulder and the body are divided in two by a median notch 32. The introduction of the cursors into the slots is facilitated by the presence of the flared out portions 18**.

Cursor 24 is shown, on FIGS. 1 and 2, in the two states which it may occupy according to its position along the slot. When, as shown on the right hand side of the figures (slot 14), the cursor is not positioned proximate one of the inscriptions borne on the surface **10*a* of the block, its shoulder 30 is jammed between the walls of the slot and the notch 32 permits the two halves of the body 26 to be forced together. When as shown on the left hand part of the figures (slot 12), the cursor is placed proximate an inscription on the block, shoulder 30 will be found within the positioning notch 22 and at the same time the two halves of the body 26** are spread apart by their elasticity to take up their rest position.

The base block 10 and the three cursors 24 are advantageously made of plastic such as polystyrene or a product commercialized under the trade name "Delrin". As may be readily understood, there is no basic reason that the block might not be likewise formed from metal. It is also preferable that the block and the cursors be of different colours.

There is thus obtained a score marker for tennis which at the same time is simple, resistant, light, inexpensive and of easy utilization. This arrangement permits the player himself not only to mark his own points and those of his adversary by placing the cursors in the slots 12 and 14 at the position of the markings 0, 15, 30 and 40, but also to indicate whether there is equality and if this is not the case, to which player the advantage belongs, by placing the cursor of slot 16 at the respective position of the inscription D or one of the inscriptions A in the prolongation of slot 12 or 14 attributed to the player who has the advantage.

It is useful to place on the rear surface 10*b* of the block a double surface adhesive 34 to enable gluing the marker onto a tennis racket, preferably at the end of its handle. Naturally, any other fastening means such as by screws or by glue may likewise be employed.

A racket is not the only support to which the marker according to the invention may be fastened. For instance, as shown on FIG. 3, block 10 may include an ear 36 or any other similar means to attach it to a chain or cord 38 enabling wearing of the marker as a pendant. The latter may also as shown on FIG. 4 be fixed on integrated into bracelet 40 to be worn as a watch.

The invention is not limited to any particular form of block. It could thus assume any number of forms for example, oval, square, rectangular, triangular or trapezoidal. It is particularly interesting when the marker is intended to be adapted to the end of the handle of the racket, to provide block 10 the same form as that end, which is generally octagonal, as shown on FIG. 5.

Insofar as the three marking slots are concerned, other arrangements than that shown on FIGS. 1, 2, 3, 4 and 5 may be adopted in which the two point marking slots are symmetrically arranged while the slot for marking equality or advantage is arranged in order that the two extremities are to be found respectively in a non-ambiguous manner proximate the slots marking the points.

It is thus for instance that an arrangement in H form may be employed or as shown on FIG. 6, the three slots may be arranged along the sides of an isosceles or equilateral triangle (in the case as shown on the figure). The equality-advantage slot 16 is found at the base of the triangle and the point marking slots 12 and 14 are along the two equal sides. These latter are symmetric relative to an axis x'x on which the slot 16 has its center point. It will be noted that this figure gives an example of realization of base 10 in square form.

The FIG. 7 gives the example of a further realization in which the slots for marking the points 12 and 14 are in the form of arcs of a circle symmetric relative to an axis x'x. The rectilinear slot 16 is then arranged along axis y'y, perpendicular to axis x'x at the center of the circle. The base block 10*a* in this example has a circular form.

Reference will now be made to FIG. 8 which shows the possibility of utilizing as base block 10, the caseband of a wrist watch which in the example as shown, has a rounded form. The point marking slots 12 and 14 extend respectively from 8 to 11 o'clock and from 4 to 1 o'clock, while the slot 16 the central point of which is at 6 o'clock extends from 5 to 7 o'clock.

FIG. 9, finally, shows a special realization of the marker according to the invention in which the base block 10, of rectangular form, has on its two opposite sides two pairs of fastening hooks 42 in the form of gutters enabling hooking onto the stringing 44 of a racket, in the portion closest to the handle thereof. The flexibility of the stringing then comes into play in order that the marker may be applied to a string, the hooks 42 enabling fastening by hooking on to the two adjacent strings.

It should be likewise evident that instead of being fastened to the end of the handle of a racket the base block might be directly incorporated therein.

In order to assure that in the position shown on the right hand side of FIG. 2, cursors 24 may not be easily withdrawn, it is advantageous to provide at the bottom of the walls of each slot between the positioning notches 22, small steps 46 (shown only on FIG. 2) which are spaced from one another a distance less than the diameter of the notches and have substantially the same depth as the latter. The ends of the shoulders 30 may thus take up a position in these steps in a manner to assure anchoring of the cursors into the base for every position of the latter all along their respective slots.

It will be evident that the same principle could be employed to enable players to keep track of their respective scores in terms of number of games won during a set.

What is claimed is:

1. A score marker for tennis comprising:

a base provided with three slots of which two first slots of the same length are symmetrically arranged relative to one another and of which the third slot is placed in a manner such that its two ends are unambiguously located respectively in proximity to the two first slots, a point scale adjacent to each of the two first slots for marking respectively the points 0, 15, 30 and 40 of opposing players, and a deuce and advantage scale adjacent to the third slot for marking simultaneously for both opposing players, one the opposing players have each achieved the score of 40, whether there is equality or to which the advantage belongs;

three cursors respectively placed in said slots so as to be slidable therealong; and positioning means serving on one hand to retain the cursors of the two first slots in four predetermined positions in which they mark the points 0, 15, 30 and 40 and on the other hand to retain the cursor of the third slot in three predetermined positions of which a central position marks equality of the opposing players and respective end positions mark that the advantage belongs to the opposing player whose points are displayed on the closest scale, the central position of the third slot being substantially equidistant from the two first slots.

2. A score marker as set forth in claim 1 wherein:

said positioning means comprises evenly spaced receptacles provided in the under surface of the base and centered on the slots in communication therewith, there being four receptacles for each of the two first point marking slots and three receptacles for the third slot, and the intermediate receptacle for the third slot being spaced substantially equidistant from each of the two first point marking slots; and, said cursors are formed from an elastically deformable material, each cursor comprising a body adapted to slide in its respective slot and having at the respective ends of said body a head supported on the top surface of the base and a shoulder of complementary form to that of said receptacles, the body and the shoulder including a central notch which defines two halves of the body and permits said two halves to be forced together such that said shoulder in accordance with the cursor position is either positioned within a receptacle with said two halves spread apart by their elasticity or jammed between the walls of the slot.

3. A score marker as set forth in claim 2 wherein said receptacles are substantially cylindrical and the shoulders of said cursors are substantially circular and have a diameter corresponding to that of said receptacles.

4. A score marker as set forth in claim 2 wherein the body of each of said cursors includes two planar parallel surfaces which are opposite to the walls of said slots.

5. A score marker as set forth in claim 1 wherein said base is of octagonal form.

6. A score marker as set forth in claim 1 wherein said two first point marking slots is are rectilinear and parallel to one another while the third slot likewise rectilinear and is perpendicular to said two first slots.

7. A score marker as set forth in claim 1 wherein the three slots are disposed along the sides of a triangle.

8. A score marker as set forth in claim 1 wherein said two first point marking slots comprise arcs of a circle symmetrically placed relative to a diameter of said circle, the third slot being rectilinear with its center at the center of the circle and positioned perpendicular to said diameter.

9. A score marker as set forth in claim 1 wherein said base is formed by the caseband of a watch and the three slots are distributed along said caseband.

10. A score marker as set forth in claim 1 further comprising means for the fastening thereof to a support.

11. A score marker as set forth in claim 10 wherein said means comprise a double surface adhesive.

12. A score marker as set forth in claim 10 wherein said means are formed by bent fastening hooks enabling attachment of said marker to the stringing of a racket.

13. A score marker as set forth in claim 1 wherein said base is fixed to a braclet.

14. A score marker as set forth in claim 1 wherein said base is fixed to the end of the handle of a racket.

15. A score marker for tennis comprising:

a base provided with three slots of which two first slots of the same length are symmetrically arranged relative to one another and of which the third slot is placed in a manner such that its two ends are unambiguously located respectively in proximity to the two first slots, a point scale adjacent to each of the two first slots for marking respectively the points 0, 15, 30 and 40 of opposing players, and a deuce and advantage scale adjacent to the third slot for marking simultaneously for both opposing players, once the opposing players have each achieved the score of 40, whether there is equality or to which the advantage belongs;

three cursors respectively placed in said slots so as to be slidable therealong; and positioning means serving on one hand to retain the cursors of the two first slots in four predetermined positions in which they mark the points 0, 15, 30 and 40 and on the other hand to retain the cursor of the third slot in three predetermined positions of which a central position marks equality of the opposing players and respective end positions mark that the advantage belongs to the opposing player whose points are displayed on the closest scale, the central position of the third slot being substantially equidistant from the two first slots;

said positioning means comprising evenly spaced receptacles provided in the under surface of the base and centered on the slots in communication therewith, there being four receptacles for each of the two first point marking slots and three receptacles for the third slot, the intermediate receptacle for the third slot being spaced substantially equidistant from each of the two first point marking slots, and opposing steps being provided at the bottom of the walls of each of said slots between said receptacles;

said cursors being formed from an elastically deformable material, each cursor comprising a body adapted to slide in its respective slot and having at the respective ends of said body a head supported on the top surface of the base and a shoulder of complementary form to that of said receptacles, the body and the shoulder including a central notch which defines two halves of the body and permits said two halves to be forced together such that said shoulder in accordance with the cursor position is either positioned within a receptacle with said two halves spread apart by their elasticity or jammed between the opposing steps at the bottom of the walls of the slot;

the diameter of said receptacles being greater than the spacing between the walls of the slot such that the ends of the shoulder of the cursor body take up a position in said receptacle to anchor said cursors into said base when said shoulder is positioned within a receptacle with the two halves of said cursor body spread apart by their elasticity;

and said opposing steps being spaced from one another by a distance greater than the spacing between the walls of the slot and less than the diameter of said receptacles such that the ends of the shoulder of the cursor body take up a position in said steps to anchor said cursors into said base when the shoulder is jammed between the opposing steps at the bottom of the walls of the slot.

* * * * *

UNITED STATES PATENT AND TRADEMARK OFFICE

CERTIFICATE OF CORRECTION

PATENT NO. : 4,738,449

DATED : April 19, 1988

INVENTOR(S) : FRANCOIS DROZ

It is certified that error appears in the above-identified patent and that said Letters Patent is hereby corrected as shown below:

Claim 1, line 12, change "one" to --once--.

Claim 6, line 2, delete "is", and
line 3, after "slot" insert --is--.

Signed and Sealed this

Second Day of August, 1988

*Attest:*

DONALD J. QUIGG

*Attesting Officer*

*Commissioner of Patents and Trademarks*